US010362653B1

(12) United States Patent
Hittle

(10) Patent No.: US 10,362,653 B1
(45) Date of Patent: Jul. 23, 2019

(54) ISOLATED DIMMING CIRCUIT

(71) Applicant: LEDVANCE LLC, Wilmington, MA (US)

(72) Inventor: Jerome Hittle, Longmont, CO (US)

(73) Assignee: LEDVANCE LLC, Ailmington, MA (US)

( * ) Notice: Subject to any disclaimer, the term of this patent is extended or adjusted under 35 U.S.C. 154(b) by 0 days.

(21) Appl. No.: 16/152,581

(22) Filed: Oct. 5, 2018

(51) Int. Cl.
*H05B 33/08* (2006.01)

(52) U.S. Cl.
CPC ..... *H05B 33/0854* (2013.01); *H05B 33/0815* (2013.01); *H05B 33/0824* (2013.01); *H05B 33/0884* (2013.01)

(58) Field of Classification Search
CPC ..... H05B 33/0815; H05B 33/0845; H05B 33/089; H05B 33/0812; H05B 33/083; H05B 33/0851; H05B 33/0818; H05B 33/0827; H05B 33/0887; H05B 33/0848; H05B 33/0809; H05B 33/0842; H05B 33/0857; H05B 33/0896; H05B 33/0824; H05B 33/0884; H05B 33/0854; H05B 33/08; H05B 33/0803; H05B 33/0806; H05B 33/0821; H05B 33/086; H05B 33/0866; H05B 33/0872; H05B 33/0893; H05B 37/02; H05B 37/0227; H05B 37/0209; H05B 37/0272; H05B 37/0245; H05B 37/0263; H05B 37/0281; H05B 37/0218; H05B 37/03; H05B 37/04; H05B 37/0254; H05B 37/029; H05B 37/00; H05B 39/044; H05B 39/041; H05B 39/047; H05B 41/14; H05B 41/46

USPC ..... 315/224, 122, 186, 200 R, 209 R, 307, 315/246, 291, 127, 206, 111.21, 119, 121, 315/159, 185 R, 201, 219, 250, 297
See application file for complete search history.

(56) References Cited

U.S. PATENT DOCUMENTS

2004/0196669 A1* 10/2004 Thrap ..... H02M 1/4258 363/19
2008/0191642 A1* 8/2008 Slot ..... H05B 33/0818 315/295
2012/0169240 A1* 7/2012 Macfarlane ..... H02M 1/4225 315/152
2012/0194078 A1* 8/2012 Ren ..... H05B 33/0818 315/122
2013/0063047 A1* 3/2013 Veskovic ..... H05B 33/0815 315/307
2015/0002049 A1* 1/2015 Hu ..... H05B 33/0848 315/307
2015/0271894 A1* 9/2015 Torre ..... H05B 37/02 315/291
2017/0013685 A1* 1/2017 Himeda ..... H05B 33/0815

* cited by examiner

*Primary Examiner* — Tung X Le
*Assistant Examiner* — Borna Alaeddini
(74) *Attorney, Agent, or Firm* — Neugeboren & O'Dowd PC

(57) ABSTRACT

This disclosure describes methods and apparatuses for controlling an isolated diming circuit. An exemplary circuit may include a voltage input device, a noninverting operational amplifier in electrical communication with a optoelectric coupler, an optoelectric coupler incorporating emitting and receiving photodevices, an inverting operational amplifier in electrical communication with the optoelectric coupler, a voltage output device in electrical communication with the inverting operational amplifier, and a lighting device.

22 Claims, 6 Drawing Sheets

ISOLATED DIMMING CIRCUIT

FIELD OF THE INVENTION

The present invention relates to methods and apparatuses for isolating a circuit. More specifically, the present invention relates to isolating a light dimming circuit through the use of an optoelectric coupler.

DESCRIPTION OF RELATED ART

Lighting comprises approximately 19% of global electricity consumption. [1] The world has been steadily transitioning away from traditional incandescent bulbs to solid state lighting (SSL) technology (e.g., LED) to meet the growing global lighting need. However, SSLs present technological problems, especially in the realm of low voltage SSL lighting (0-10V range) dimming. Solid state lighting is often advertised as being completely dimmable since the SSL technology maintains efficiency when dimmed, in contrast to incandescent sources which become less efficient at high dimming percentages. As such, many manufacturers recommend installing dimming circuitry with the SSL device. However, since SSLs respond rapidly to slight change in current, even a slight current change in the dimming circuitry can significantly affect the light output.

[1] http://www.earth-policy.org/datacenter/pdf/book_wote_energy_efficiency-.pdf

Due to SSL's rapid current response, dimming circuitry is susceptible to interference from other electrical sources that cause unwanted voltage in the circuitry. This problem is exacerbated when multiple lights are connected in close physical proximity with one another. For example, most zero to ten volt light dimming circuits are non-isolating and susceptible to leakage currents between the dimming circuitry and the light. This generally does not affect the SSL's functionality if dimming circuitry is only being used with a small number of lights (e.g. 3-5 SSLs). However, as more lights are connected to a dimming circuit, more leakage currents flow. These leakage currents can cause problems with local circuitry, radiated susceptibility (due to non-shielded wire), and with meeting the Federal Communications Commission's regulatory requirements for radio interference. To solve this problem, circuit isolation is required to prevent leakage interference with the dimming capabilities of SSLs. For multiple SSLs in close physical proximity, isolating circuitry is especially required.

SUMMARY OF THE INVENTION

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

One aspect of the invention may be characterized as an isolated dimming circuit. The circuit can include a voltage input device, a noninverting operational amplifier, an inverting operational amplifier, an optoelectric coupler, a voltage output device, and a lighting device. The noninverting operational amplifier can include a first non-feedback input that is in electrical communication with the voltage input device, a first feedback input, a first power source input that is in electrical communication with a first power source, and a first output. In some embodiments, the first power source is in electrical communication with the first power source input of the noninverting operational amplifier and is a solar, battery, or power stealing source. The inverting operational amplifier can include a second non-feedback input, a second feedback input, a second power source input that is in electrical communication with a second power source, and a second output. In some embodiments, the second power source is in electrical communication with the second power source input of the inverting operational amplifier and is a solar, battery, or power stealing source. The optoelectric coupler can include an emitting photodevice that in electrical communication with the first output of the noninverting operational amplifier, a first receiving photodevice that is in optical communication with the emitting photodevice and is in electrical communication with the first feedback input of the noninverting operational amplifier and is positioned in a first circuit that is configured for a first current, a second receiving photodevice that is in optical communication with the emitting photodevice and is in electrical communication with the second non-feedback input of the inverting operational amplifier and is positioned in a second circuit that is configured for a second current, and the first and second currents are operationally configured to be matched by a current factor. In some embodiments, the emitting photodevice is a light emitting diode (LED).

In accordance with other aspects the first and second receiving photodevices are photodiodes. In some embodiments, the first and second receiving photodevices are photoresistors. In some embodiments, the first and second receiving photodevices are phototransistors. The voltage output device can be in electrical communication with the second output of the inverting operational amplifier. In some embodiments, the voltage output device is operationally configured for a range of 0-10 Volts. The lighting device can be in electrical communication with the voltage output device. In some embodiments, the lighting device is a solid-state light.

In accordance with further aspects, the isolated dimming circuit can also include a voltage divider that is in electrical communication with the second output of the inverting operational amplifier and the second feedback input of the inverting operational amplifier. The voltage divider can include a first resistor, a second resistor, and a ground where the first resistor and the second resistor are positioned in series, the first resistor is positioned between the second output of the inverting operational amplifier and the second feedback input of the inverting operational amplifier, and the second resistor is positioned between the second feedback input of the inverting operational amplifier and the ground.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The words "for example" is used herein to mean "serving as an example, instance, or illustration." Any embodiment described herein as "for example" is not necessarily to be construed as preferred or advantageous over other embodiments.

The flowcharts and block diagrams in the following Figures illustrate the architecture, functionality, and operation of possible implementations of devices, systems, methods, and computer program products according to various embodiments of the present invention. In this regard, some blocks in these flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Figure 1:
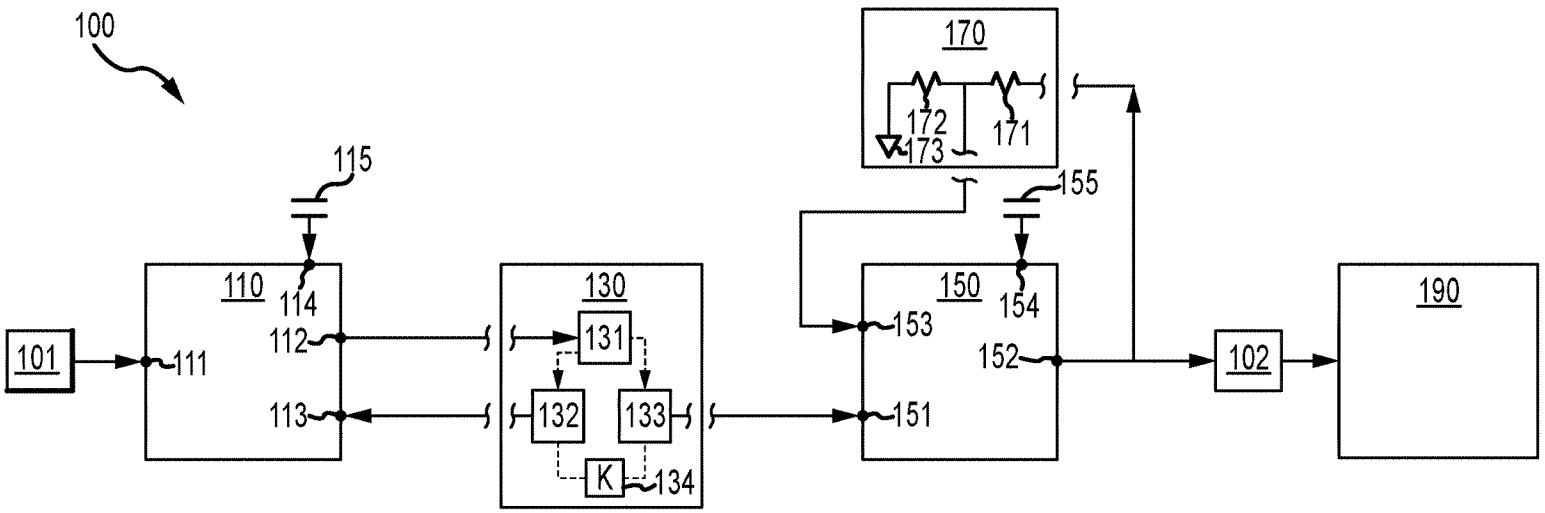
FIG. 1 illustrates a block diagram depicting physical components that may be utilized in an isolated dimming circuit in accordance with embodiments described herein.

FIG. 1 illustrates isolated dimming circuit 100. Isolated dimming circuit 100 may comprise voltage input device 101, noninverting operational amplifier 110, optoelectric coupler 130, inverting operational amplifier 150, voltage divider 170, voltage output device 102, and lighting device 190.

Voltage input device 101 may supply AC or DC current; this can be through various means such as a wall outlet, battery pack, or a solar cell. Voltage input device 101 is in electrical communication with first non-feedback input 111, which is the primary voltage input of noninverting operational amplifier 110.

Isolated dimming circuit 100 includes noninverting operational amplifier 110. As is known in the art, operational amplifiers are versatile devices that can be used in many applications in electronic circuits including, but not limited to, voltage amplifiers, filters, and signal conditioners. Operational amplifiers, such as operational amplifier 110, have high gain capabilities such that a low voltage input may be increased by orders of magnitude to a corresponding current output. Operational amplifiers have a differential input dependency such that the output voltage from the operational amplifier is proportional to the difference of the two voltage inputs. This differential dependency is directly related to the type of operational amplifier configuration.

As is known in the art, two basic types of operational amplifier configurations exist, inverting and noninverting. A noninverting operational amplifier's output is in phase with the input. Negative feedback is the process of feeding back a fraction of the output current back to the noninverting operational amplifier's feedback input to decrease the overall output current of the operational amplifier. The feedback terminal receives a fraction of the output current that has been reduced (for example, by a resistor positioned before the feedback terminal). This reduced feedback current creates negative feedback in that the operational amplifier's overall output current by reducing the differential between the feedback and non-feedback input voltages to the noninverting operational amplifier, thus reducing the overall output current.

In accordance with one aspect, noninverting operational amplifier 110 is a noninverting type operational amplifier. Noninverting operational amplifier 110 includes a first non-feedback input 111. First non-feedback input 111 receives the primary voltage to noninverting operational amplifier 110. First non-feedback input 111 is in electrical communication with voltage input device 101.

Noninverting operational amplifier 110 includes first output 112. First output 112 is the primary current output of noninverting operational amplifier 110. As discussed previously, first output 112 is directly related to the differential in voltages between first non-feedback input 111 and feedback input 113. First feedback input 113 supplies a negative feedback current that reduces the overall current amount of first output 112. First output 112 is in electrical communication with an isolating device. In some embodiments, the isolating device may be an optoelectric coupler.

Noninverting operational amplifier 110 includes first feedback input 113. First feedback input 113, as referred to previously, supplies a negative feedback current to noninverting operational amplifier 110. This feedback current reduces first output voltage 112 in proportion to the differential in voltages between first feedback input voltage 113 and first non-feedback input 111. The current of first feedback input 113 is supplied by an isolating device. In some embodiments, the isolating device may be an optoelectrical coupler.

Noninverting operational amplifier 110 includes first power source input 114 that is in electrical communication with first power source 115. First power source 115 may be supplied by a variety of power sources including solar, battery, power stealing, or a combination of known power sources. First power source 115 supplies the source of power utilized by noninverting operational amplifier 110 to amplify the input current of first non-feedback input 111 to the output current of first output 112.

Noninverting operational amplifier 110 is in electrical communication with an isolating device such as an optoelectrical coupler 130. Optoelectric coupler 130 is an optical type isolator. Optical isolators are used to pass a signal between two circuits that require electrical isolation from one another. Electrical isolation exists when the two circuits have no conductors in common. This may be necessary to prevent noise generated in one circuit from being passed to the other circuit. 0-10 volt light dimming circuits are commonly non-isolating. This non-isolation makes the dimming circuits susceptible to leakage currents between the dimming circuitry and the lighting device. As more lighting devices are employed, the problem compounds in that more leakage currents radiate and interfere with the functionality of the dimming control. Utilizing electrical isolation, such as optoelectric coupler 130, solves this problem by isolating the individual circuits and preventing the interference.

As stated previously, optoelectric coupler 130 is an optical isolator. Optical isolators use light to transfer optical signals between circuits which electrically isolates the circuits from one another. Optical isolators connect an input and output photodevice with a beam of light which modulates based upon an input current. The optical isolator transforms the electrical input signal into light via an emitting photodevice, sends the light across a dielectric channel, receives light on the receiving photodevice, and transforms the light back into electric signal. This process creates complete electrical isolation of the input and output circuits via light. Typical optical isolators require at least one emitting photodevice and at least one receiving photodevice. The emitting photodevice transforms the input signal into light and sends the light to the receiving device. The receiving photodevice receives the light from the emitting photodevice and transforms the light into a current. Emitting photodevices may be a variety of emitting type optical devices, for example light emitting diodes (LEDs). Receiving photodevices may be a variety of receiving optical devices, for example photodiodes and photoresistors.

Optoelectric coupler 130 includes emitting photodevice 131, which is an emitting type photodevice. As discussed previously, emitting photodevice 131 may be an LED type. Emitting photodevice 131 is in electrical communication with noninverting operational amplifier 110 via first output 112. Emitting photodevice 130 is also in optical communication with one or more receiving photodevices. Light emitted from emitting photodevice 131 is received by one or more receiving photodevices which transforms the received light into an electrical signal.

Optoelectric coupler 130 includes one or more receiving photodevices. In some embodiments, such receiving photodevices are first receiving photodevice 132 and second receiving photodevice 133. First receiving photodevice 132 and second receiving photodevice 133, as discussed previously, may be a variety of receiving type photodevices including photodiodes or photoresistors. First receiving photodevice 132 and second receiving photodevice 133 are in optical communication with emitting photodevice 131. First receiving photodevice 132 and second receiving photodevice 133 are in electrical communication with two or more circuits.

Within optoelectric couplers, multiple receiving photodevices may be matched or synched in their output voltages via a current factor. This current factor correlates the outputs of two or more receiving photodevices to a common emitting photodevice. This current factor may be calculated to match the currents, by a determined proportion, of the two or more isolated circuits connected to the receiving photodevices. The current factor may also be calculated to match the circuit connected to the emitting photodevice current with the circuit connected to at least one receiving photodevice.

Optoelectric coupler 130 includes current factor 134. Current factor 134 may be a factor that matches the currents of one or more emitting photodevices with one or more receiving photodevices. In some embodiments, the emitting photodevice is emitting photodevice 131 and the receiving photodevices are first receiving photodevice 132 and second receiving photodevice 133. The current supplying emitting photodevice 131 are matched, by current factor 134, to the currents outputted from first receiving photodevice 132 and second receiving photodevice 133 by a predetermined proportion.

With the current factor, a relationship between two isolated circuits can be accomplished, such as voltage following. Voltage following is when a first circuit sets the current of one or more additional isolated circuits through non-electrical communication. With optoelectrical coupling, it is possible to create voltage following when the current factor relates the currents to one another such that the input current and output currents of the optoelectric coupler are the same. For example, optoelectric coupler 130, by current factor 134, matches the current supplying emitting photodevice 131 with the current outputted from second receiving photodevice 133. This creates a voltage following relationship between the first circuit (first output 112 of noninverting operational amplifier 110) and the second circuit (second non-feedback input 151 of inverting operational amplifier 150).

As discussed previously, two basic types of operational amplifiers exist. The second basic type of operational amplifier configuration is an inverting operational amplifier. An inverting operational amplifier's output is the inverse (e.g. 180° out of phase) with the input. Inverting operational amplifier's may also receive feedback, similar noninverting operational amplifiers. In inverting operational amplifiers, negative feedback decreases the output current of the inverting operational amplifier by reducing the differential between the feedback and non-feedback inputs to the inverting operational amplifier.

In accordance with one aspect, inverting operational amplifier 150 is an inverting type operational amplifier. Inverting operational amplifier 150 includes first non-feedback input 151. First non-feedback input 151 receives the primary voltage to inverting operational amplifier 150. First non-feedback input 151 is in electrical communication with a voltage supply. The voltage supply may be from an isolating device, such as optoelectric coupler 130. For example, optoelectric coupler 130 is in electrical communication with second non-feedback input 151 of inverting operational amplifier 150 by an optical communication to second receiving photodevice 133.

Inverting operational amplifier 150 includes second output 152. Second output 152 is the primary current output of inverting operational amplifier 150. As discussed previously, second output 152 is directly related to the differential in voltages between second non-feedback input 151 and second feedback input 153. Second feedback input 153 supplies a negative feedback current, that as discussed previously, reduces the output current amount of second output 152.

The feedback current can be supplied by a connection to the primary current output. This connection supplies a proportion of the output current back to the feedback input of the inverting operational amplifier to reduce the overall output current of the inverting operational amplifier. In some embodiments the reduction of the output current may be accomplished by one or more resistors. For example, second output current 152 may be reduced by electrical communication with first resistor 171. In other embodiments, the current reduction may be accomplished by a voltage divider. The voltage divider reduces the current by a proportion based upon two or more resistors in electrical communication with a ground. For example, second output current 152 may be reduced by voltage divider 170 which comprises first resistor 171 and second resistor 172 in electrical communication with ground 173.

Inverting operational amplifier 150 also includes second power source 155 that is in electrical communication with second power source input 154. Second power source 155 may be supplied by many different power sources including solar, battery, power stealing, or a combination of known power sources. Second power source 155 supplies the source of power utilized by inverting operational amplifier 150 to amplify the voltage difference between second non-feedback input 151 and second feedback input 153, resulting in the current of second output 152.

Inverting operational amplifier 150 is in electrical communication with a voltage output device 102 though second output 152. Voltage output device 102 is in electrical communication with lighting device 190. Lighting device 190 may be a variety of lighting devices such as solid-state lighting (SSL), and specifically, LED type devices. Such lighting devices may require dimming capabilities. In some embodiments, such lighting devices may have an operational range of 0-480 volts. In other embodiments, such lighting device have an operational range of 0-277 volts. In further embodiments, such lighting device have an operational range of 0-10 volts.

The supply voltage requirements of the lighting device creates the voltage boundaries of the supplying circuit's currents. The supplying circuitry must meet the output voltage requirements of the lighting device. This creates a boundary for which the circuits must fall within. Importantly, the operational limits may limit the range of the inputs to operational amplifiers in these circuits.

For example, the input voltage to lighting device 190 limits the output voltage of inverting operational amplifier 150 since inverting operational amplifier 150 supplies the current to lighting device 190. Second output 152 of inverting operational amplifier 150 is based upon the differential between second feedback input 153 and second non-feedback input 151. This creates a boundary of operation for the maximum voltage of second non-feedback input 151 which is in electrical communication with second receiving photodevice 133 in optoelectric coupler 130. Additionally, this also creates a limit on the first output of noninverting operational amplifier 110 as first output 112 is in electrical communication with emitting photodevice 131. Since current factor 134 matches the output currents of emitting photodevice 131 and second receiving photodevice 133, this creates the maximum current that noninverting operational amplifier 110 can output.

Figure 2:
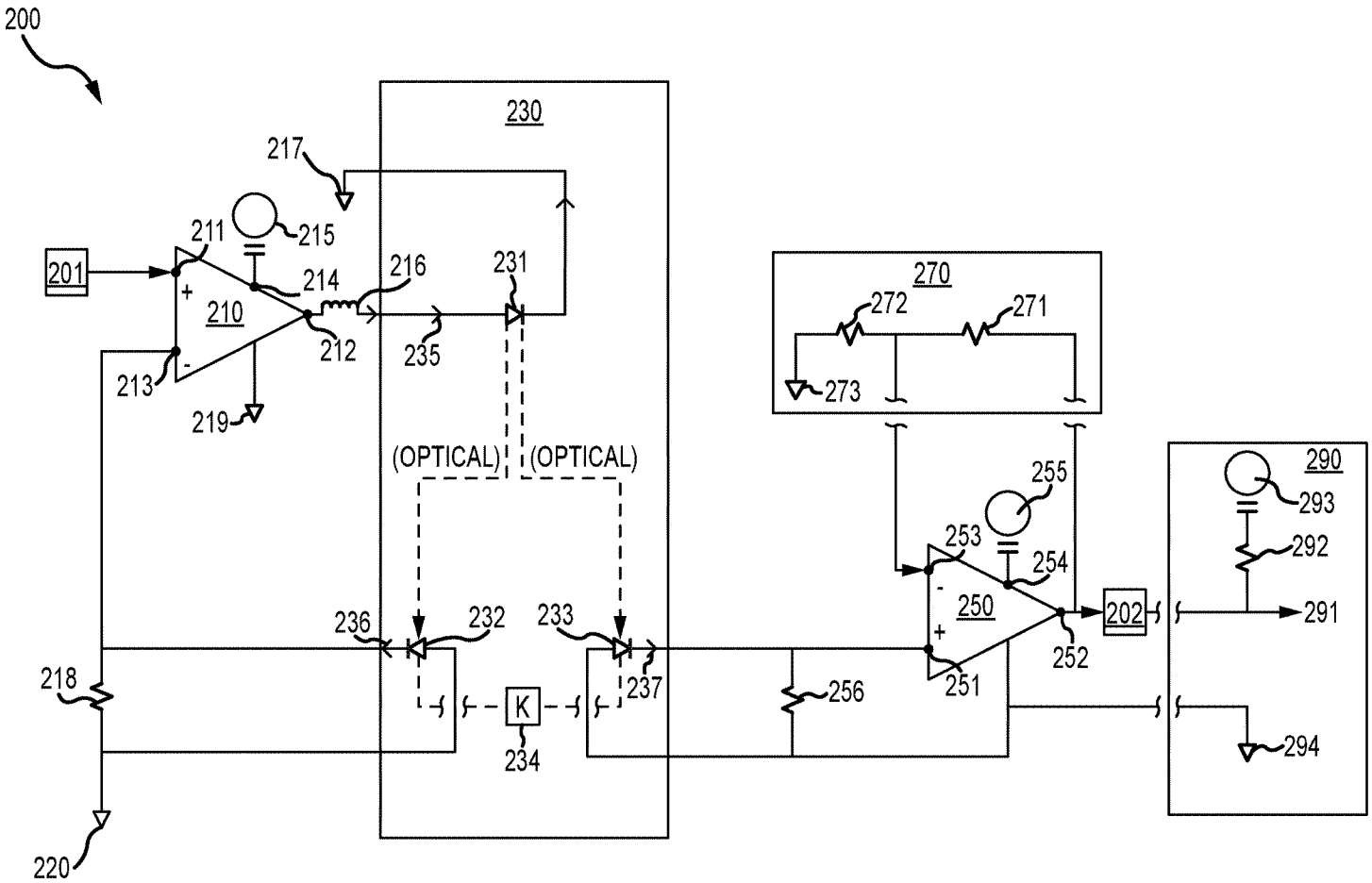
FIG. 2 illustrates a sample circuit diagram of an isolated dimming circuit in accordance with embodiments described herein.

With reference to FIG. 2, a sample circuit diagram of isolated dimming circuit 200 is illustrated. Isolated dimming circuit 200 may be the same as isolated dimming circuit 100. Isolated dimming circuit may comprise voltage input device 201, noninverting operational amplifier 210, optoelectric coupler 230, inverting operational amplifier 250, voltage divider 270, voltage output device 202, and lighting device 290.

Isolated dimming circuit 200 includes voltage input device 201. In some embodiments, voltage input device 201 is the same as voltage input device 101. Voltage input device 201 is in electrical communication with first non-feedback input 211, which is the primary voltage input of noninverting operational amplifier 210. In some embodiment, first non-feedback input 211 is the same as first non-feedback input 111.

Isolated dimming circuit 200 includes noninverting operational amplifier 210, which is a noninverting type operational amplifier. In some embodiments, noninverting operational amplifier 210 is the same as noninverting operational amplifier 110. Noninverting operational amplifier includes first non-feedback input 211. First non-feedback input 211 receives the primary voltage to noninverting operational amplifier 210. First non-feedback input 211 is in electrical communication with voltage input device 201.

Noninverting operational amplifier 210 includes first output 212. In some embodiments, first output 212 is the same as first output 112. First output 212 is the primary current output of noninverting operational amplifier 210. Similar to the previous discussion of isolated dimming circuit 100, first output 212 is directly related to the differential in voltages between first non-feedback input 211 and first feedback input 213. In some embodiments, first feedback input 213 is the same as first feedback input 113. First feedback input 213 may supplies a negative feedback current that reduces the overall current amount of first output 212. First output 212 is in electrical communication with an isolating device, which in some embodiments may be an optoelectric coupler.

Noninverting operational amplifier 110 includes first feedback input 213. First feedback input 213, as referred to above, supplies a negative feedback current to noninverting operational amplifier 210. This negative feedback reduces first output voltage 212 in direct relation to the differential in voltages between first feedback input voltage 213 and first non-feedback input 211. The current of first feedback input 213 may is supplied by an isolating device. In some embodiments, the isolating device may be an optoelectrical coupler.

Noninverting operational amplifier 210 includes first power source input 214 that is in electrical communication with first power source 215. In some embodiments, first power source input 214 is the same as first power source input 114, and first power source 215 is the same as first power source 115. Similar, to first power source 115, first power source 215 may be supplied by many different power sources including solar, battery, power stealing, or a combination of known power sources. First power source 215 may supplies the source of power utilized by noninverting operational amplifier 210 to amplify the input current of first non-feedback input 211 to the output current of first output 212.

Noninverting operational amplifier 210 is also in electrical communication with inductor 216. Inductor 216 is used to prevent current fluctuation in the output current of operational amplifier 210. Due to an inductors electromagnetic resistance to current changes, inductor 216 prevents current fluctuations of first output 216. Noninverting operational amplifier 210 includes noninverting operational amplifier feedback resistor 218 which is positioned before first feedback input 213. As discussed previously, operational amplifier 210 receives feedback from first feedback input 213. Noninverting operational amplifier feedback resistor 218 reduces the current amount that first feedback input 213 receives. Noninverting operational amplifier feedback resistor 218 is used to lower the amount of current that operational amplifier 210 produces by decreasing the differential between feedback input 213 and non-feedback input 211 to operational amplifier 210. Noninverting operational amplifier 230 is also in electrical communication with ground 219, ground 217, and ground 220.

Noninverting operational amplifier 210 is in electrical communication with an isolating device such as optoelectrical coupler 230. In some embodiments, optoelectric coupler 230 is the same as optoelectric coupler 130. Similar to circuit 100, optoelectric coupler 230 is an optical isolator. Optoelectric coupler 230 includes emitting photodevice 231 which is an emitting type photodevice. In some embodiments, emitting photodevice 231 is the same as emitting photodevice 131. As previously discussed in relation to optoelectric coupler 130, emitting photodevice 231 may be an LED type. Emitting photodevice 231 is in electrical communication with noninverting operational amplifier 210 via first output 212. Emitting photodevice 231 is in optical communication with one or more receiving photodevices. Light emitted from emitting photodevice 231 is received by one or more receiving photodevices which transforms the received light into an electrical signal.

Optoelectric coupler 230 includes one or more receiving photodevices. In some embodiments, the receiving photodevices are first receiving photodevice 232 and second receiving photodevice 233. In some embodiments, first receiving photodevice 232 is the same as first receiving photodevice 132, and second receiving photodevice 233 is the same as second receiving photodevice 133. First receiving photodevice 232 and second receiving photodevice 233, similar to circuit 200, may be a variety of receiving type photodevices, which may be photodiodes or photoresistors. First receiving photodevice 232 and second receiving photodevice 233 are in optical communication with emitting photodevice 231. First receiving photodevice 232 and second receiving photodevice 233 are in electrical communication with two or more circuits.

As discussed in relation to optoelectric coupler 130, multiple receiving photodevices may be synched in their output voltage via a current factor. This current factor correlates the outputs of two or more receiving photodevices to a common emitting photodevice. This current factor may be calculated to match the currents, by a determined proportion, of the two or more isolated circuits connected to the receiving photodevices. In other embodiments, the current factor may be calculated to match the circuit connected to an emitting photodevice.

Optoelectric coupler 230 includes current factor 234. In some embodiments, current factor 234 is the same as current factor 134. Current factor 234 is a factor that matches the currents of one or more emitting photodevices with one or more receiving photodevices. In some embodiments, the emitting photodevices is emitting photodevice 231 and the current of the emitting photodevice is emitting photodevice current 235. The receiving photodevices are first receiving photodevice 232 and second receiving photodevice 233. The current of first receiving photodevice 232 is receiving photodevice current 236. The current of second receiving photodevice 233 is second receiving photodevice current 237. First receiving photodevice current 236 and second receiving photodevice current 237 may be matched by current factor 234. For example, emitting photodevice current 235 may be matched, by current factor 234, to both first receiving photodevice current 236 and second receiving photodevice current 237.

With the current factor, a relationship between two isolated circuits can be accomplished such as voltage following. Voltage following is when a first circuit sets the current of one or more additional circuits via non-electrical communication. With optoelectrical coupling, it is possible to create a voltage following when the current factor relates the currents to one another such that the input currents and output currents of the optoelectric coupler are the same. For example, optoelectric coupler 250, via current factor 234 matches emitting photodevice current 235 with first receiving photodevice current 236 and second receiving photodevice current 237. This creates a voltage following relationship between the first circuit (first output 212 of noninverting operational amplifier 210) and the second circuit (second non-feedback input 251 of inverting operational amplifier 250).

In accordance with one aspect, inverting operational amplifier 250 is an inverting type operational amplifier. In some embodiments, inverting operational amplifier 250 is the same as inverting operational amplifier 150. Similar to inverting operational amplifier 150, inverting operational amplifier 250 includes a first non-feedback input 251. In some embodiments, first non-feedback input 251 is the same as first non-feedback input 151. First non-feedback input 251 receives the primary voltage to inverting operational amplifier 250. First non-feedback input 251 is in electrical communication with a voltage supply. The voltage supply may be from an isolating device such as optoelectric coupler 230. For example, optoelectric coupler 230 is in electrical communication with second non-feedback input 251 of inverting operational amplifier 250 by an optical communication with second receiving photodevice 233.

Inverting operational amplifier 250 includes second output 252. In some embodiments, second output 252 is the same as second output 152. Second output 152 is primary current output of inverting operational amplifier 250. As discussed in relation to inverting operational amplifier 150, second output 252 is directly related to the differential in voltages between second non-feedback input 251 and second feedback input 253. In some embodiments, second feedback input 253 is the same as second feedback input 153. Second feedback input 253 supplies a feedback current that reduces the output current amount of second output 252.

The feedback current can be supplied by a connection to the primary current output. This connection supplies a proportion of the output current back to the feedback input of the inverting operational amplifier to reduce the overall output current of the inverting operational amplifier. In some embodiments the reduction of the output current may be accomplished by one or more resistors. For example, second output current 252 may be reduced by electrical communication with first resistor 271. In other embodiments, the current reduction may be accomplished by a voltage divider. The voltage divider reduces the current by a proportion based upon two or more resistors in electrical communication with a ground. For example, second output current 252 may be reduced by voltage divider 270 which comprises first resistor 271 and second resistor 272 in electrical communication with ground 273. In some embodiments, voltage divider 270 is the same as voltage divider 170, first resistor 271 is the same as first resistor 171, second resistor 272 is the same as 172, and ground 273 is the same as ground 173.

Inverting operational amplifier 250 also includes second power source 255 that is in electrical communication with second power source 254. In some embodiments, second power source 255 is the same as second power source 155 and second power source input 254 is the same as second power source 154. Similar to second power source 155, second power source 255 may be supplied by many different power sources including solar, battery, power stealing, or a combination of known power sources. Similar to second power source 155, second power source 255 may supplies the source of power utilized by inverting operational amplifier 250 to amplify the voltage difference between second non-feedback input 251 and second feedback input 253, resulting in the current of second output 252.

Inverting operational amplifier 250 is also in electrical communication with a non-feedback resistor 256 though non-feedback input 251. Non-feedback resistor 256 lowers the current supplied to the non-feedback input. As discussed previously, the reduction of the input current to inverting operational amplifier 250 will cause for a reduction in the output current of the operational amplifier as the output voltage depends on the differential between the input currents.

Inverting operational amplifier 250 is in electrical communication with voltage output device 202 through second output 252. In some embodiments, voltage output device 202 is the same as voltage output device 102. Voltage output device 202 is in electrical communication with lighting device 290. In some embodiments, lighting device 290 is the same as lighting device 190.

Similar to lighting device 190, lighting device 290 device may be a variety of lighting devices such as solid-state lighting (SSL), and specifically, LED type devices. Such lighting devices may require dimming capabilities. Such lighting devices may require dimming capabilities. In some embodiments, such lighting devices may have an operational range of 0-480 volts. In other embodiments, such lighting device have an operational range of 0-277 volts. In further embodiments, such lighting device have an operational range of 0-10 volts.

lighting device 290 includes light power source 293 which is the primary source of power to lighting device 290. The light power source is in electrical communication with resistor 292 which lowers the amount of current to the lighting device. The lighting device is also in electrical communication with ground 294.

Similar to lighting device 190, the voltage supplying circuitry must meet the output voltage requirements of the lighting device. This creates a boundary for which the circuits must fall within. Importantly, the operational limits may limit the range of the inputs to operational amplifiers in these circuits. For example, lighting device voltage input 291 limits the output voltage of inverting operational amplifier 250 since inverting operational amplifier 250 supplies the current to lighting device input voltage input 291. Second output 252 of inverting operational amplifier 250 is based upon the differential between second feedback input 253 and second non-feedback input 251. This creates a boundary of operation for the maximum voltage of second non-feedback input 251 as this is in electrical communication with second receiving photodevice 233 in optoelectric coupler 230. Additionally, this also creates a limit on the first output of noninverting operational amplifier 210 as first output 212 is in electrical communication with emitting photodevice 231. Since current factor 234 matches emitting photodevice current 235 with both first receiving photodevice current 236 and second receiving photodevice 237, this creates the maximum current that noninverting operational amplifier 210 can output.

Figure 3:
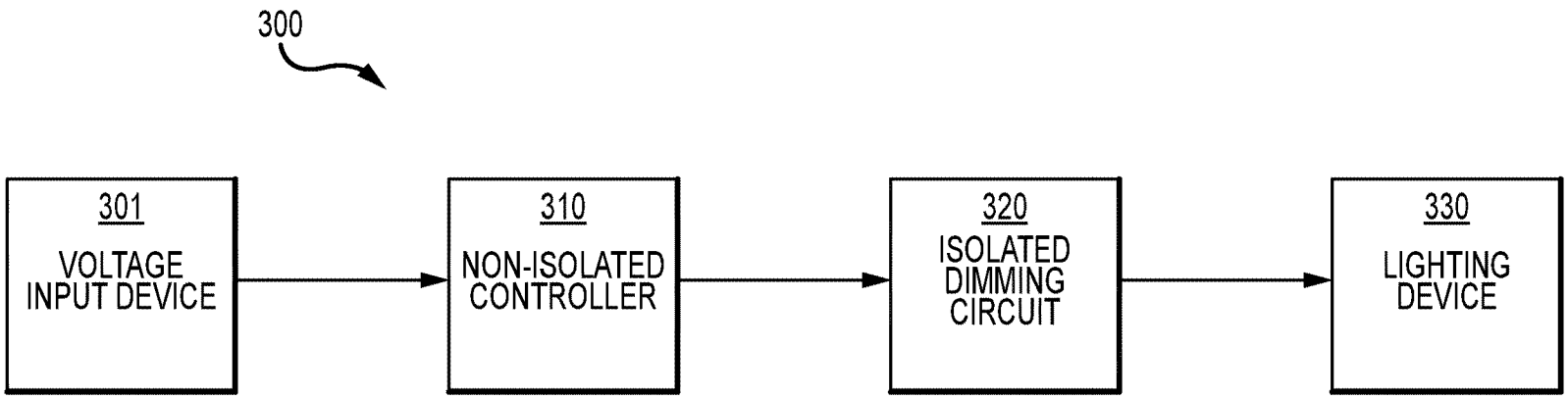
FIG. 3 illustrates a schematic of utilizing an isolated dimming circuit in conjunction with a non-isolated controller in accordance with embodiments described herein.

With reference to FIG. 3, a schematic of utilizing an isolated dimming circuit in conjunction with a non-isolated controller is illustrated. Non-isolated controller 310 may be a variety of controllers that do not isolate multiple circuits from one another. With this type of controller, problems of current leakage exist. An isolated dimming circuit, such as isolated dimming circuit 100, or isolated circuit 200, can be used to overcome these problems.

FIG. 300 illustrates how an isolated dimming circuit may be used in conjunction with a non-isolated controller to solve current leakage problems. Non-isolated controller 310 is in electrical communication with voltage input device 301. Voltage input device 301 may be the same as voltage input device 101 or 201. Isolated dimming circuit 320 is used to isolate non-isolated controller 310 from lighting device 330. Isolated dimming circuit 320 may be the same as isolated dimming circuit 100 or isolated dimming circuit 200. The lighting device may be the same as lighting device 190 or lighting device 290. Similar to lighting device 190, the lighting device may be a variety of lighting devices which may be solid state lights (SSL), and specifically LED's.

Figure 4A:
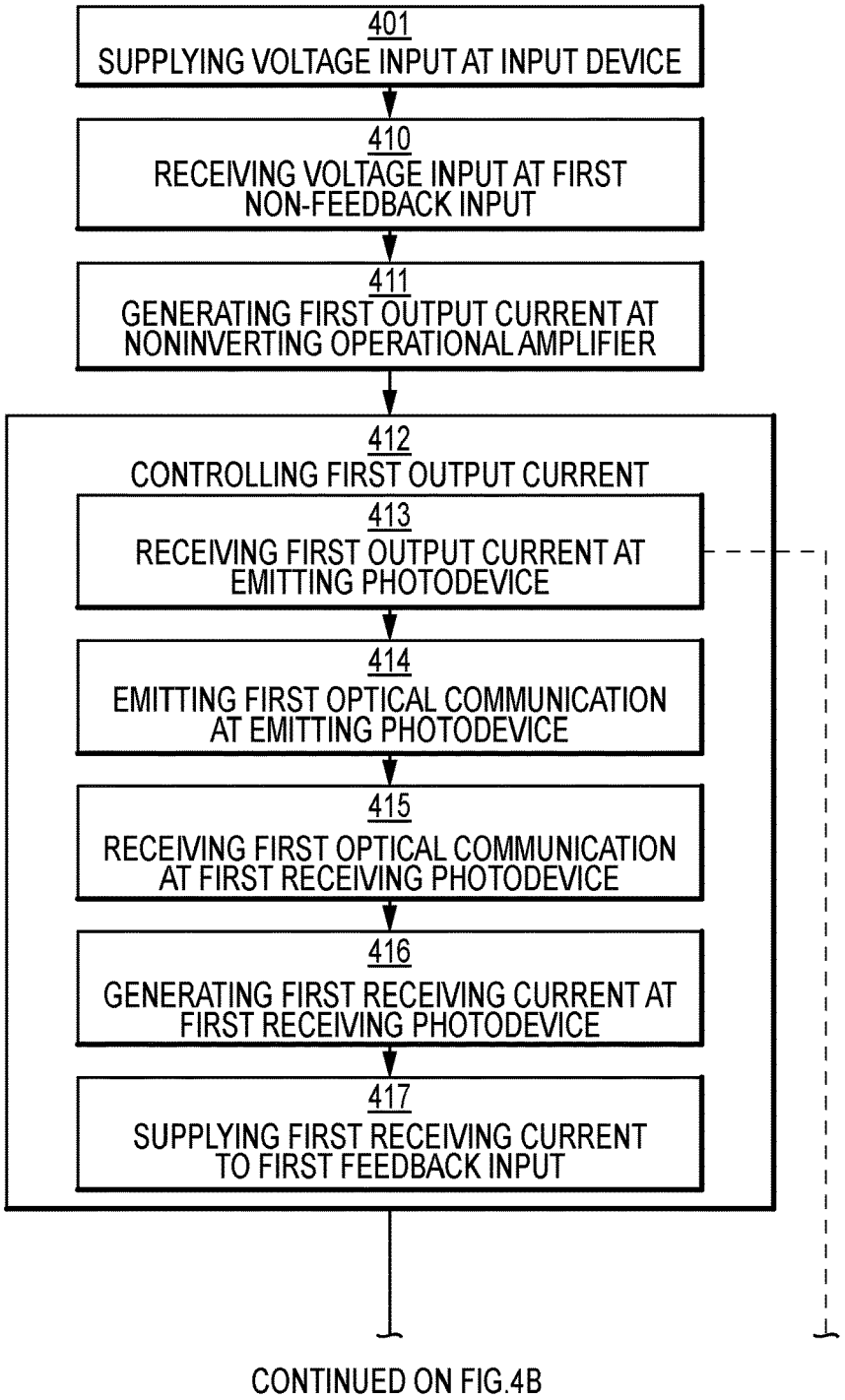
FIG. 4A and FIG. 4B illustrate a method of operation of an isolated dimming circuit with embodiments described herein.
Figure 4B:
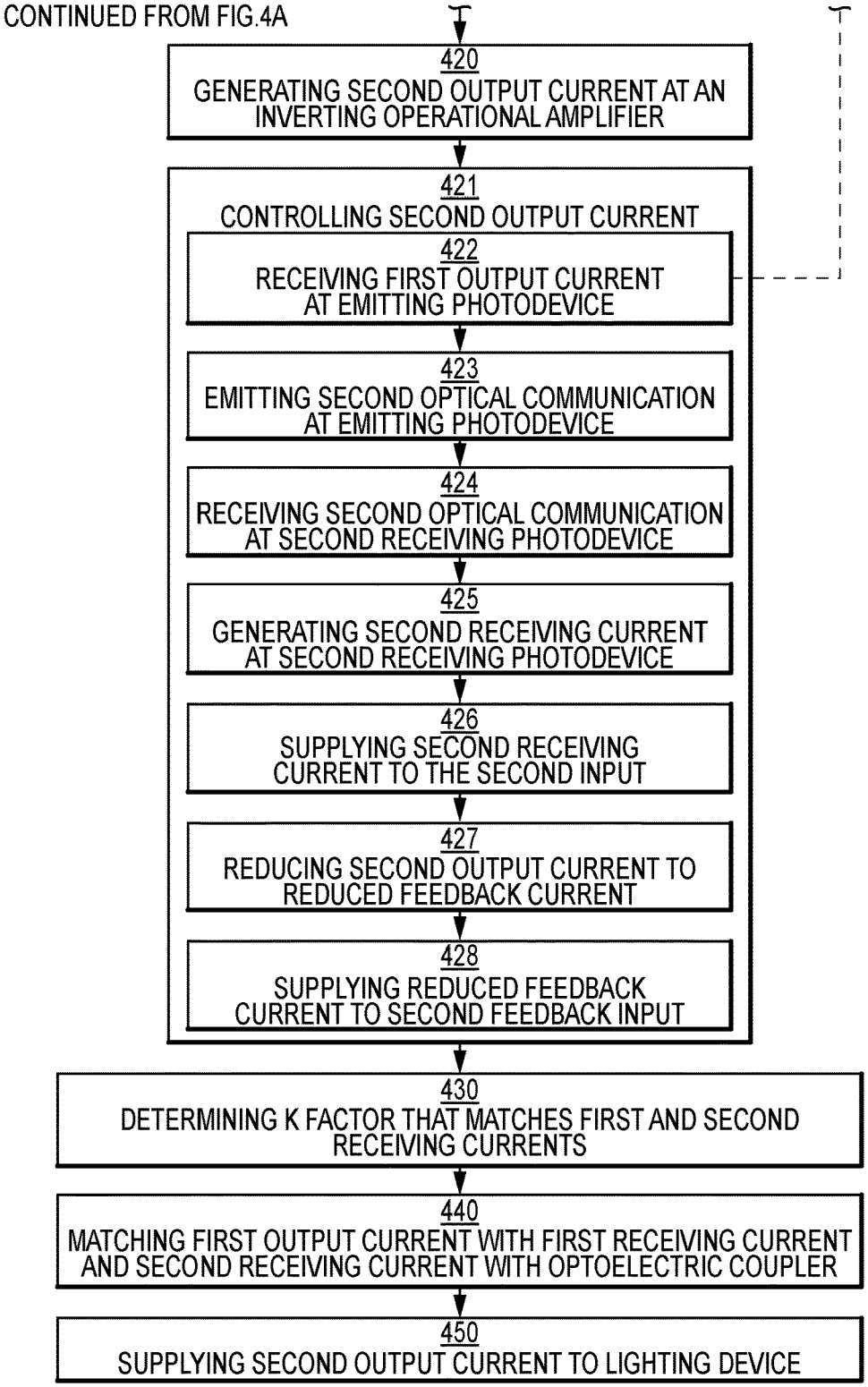

With reference to FIG. 4A and FIG. 4B a method of operation of an isolated dimming circuit is illustrated. The method comprises supplying a voltage input at an input device 401, receiving a voltage input at a first non-feedback input of an operational amplifier 410, generating a first output current at a noninverting operational amplifier 411, controlling the first output current of the noninverting operational amplifier 412, generating a second output current at an inverting operational amplifier 420, controlling the second output of the noninverting operational amplifier 421, determining a current factor for the first and second receiving currents 430, matching the output of the first output current with the first and second receiving currents 440, and supplying the second output current to a lighting device 450. One of skill in the art would appreciate that any of these given operations may be occurring independently or concurrently, and is not limited by the order of discussion as presented below or illustrated in FIG. 4A and FIG. 4B.

Starting at FIG. 4A, an input voltage is supplied to an input device at operation 401. The input device may be voltage input device 101 or voltage input device 201. The voltage input is received by a first non-feedback input of a noninverting operational amplifier at operation 410. The first non-feedback input may be first non-feedback input 111 or first non-feedback input 211. The operational amplifier receiving the non-feedback input may be noninverting operational amplifier 110 or noninverting operational amplifier 210.

At operation 411, a first output current is generated at a noninverting operational amplifier. The first output current may be in electrical communication with first output 112 or first output 212. The first output current of the noninverting operational amplifier is controlled at operation 412. Operation 412 controls the output current of the noninverting operational amplifier and further comprises the operations of receiving a first output current at an emitting photodevice 413, emitting a first optical communication at the emitting photodevice 414, receiving a first optical communication at a first receiving photodevice 415, generating a first receiving current at a first receiving photodevice 416, and supplying the first receiving current to the first feedback input of a noninverting operational amplifier first feedback input 417.

A first output current is received at an emitting photodevice at operation 413. The first output current may be emitting photodevice current 235. The emitting photodevice may be emitting photodevice 131 or emitting photodevice 231. The emitting photodevice is a component of an optoelectric coupler, which may be optoelectric coupler 130 or optoelectric coupler 230. A first optical communication is emitted at an emitting photodevice at operation 414. A first receiving photodevice receives a first optical communication from an emitting photodevice at operation 415. The first receiving photodevice may be first receiving photodevice 132 or first receiving photodevice 232. The receiving photodevice generates a first receiving current at operation 416. The first receiving current generated may be first receiving current 236. The first receiving current is supplied back to the noninverting operational amplifier through a first feedback input at operation 417. The first feedback input may be first feedback input 113 or first feedback input 213.

In other words, to control the first output current of the noninverting operational amplifier, a first output current of a noninverting operational amplifier is received at an emitting photodevice. The emitting photodevice then emits a first optical communication to a first receiving photodevice. The first receiving photodevice then generates a first receiving current. The first receiving current then supplies the first receiving current back to the first feedback input of the operational amplifier.

The method of isolating a dimming circuit continues on FIG. 4B. At operation 420, a second output current is generated at an inverting operational amplifier output. The output may be second output 152 or second output 252. The second output current of the inverting operational amplifier is controlled at operation 421. Operation 421 controls the output current of the inverting operational amplifier and further comprises the operations of receiving a first output current at an emitting photodevice 422, emitting a second optical communication at the emitting photodevice 423, receiving a second optical communication at a second receiving photodevice 424, generating a second receiving current at a second receiving photodevice 425, supplying the second receiving current to the second non-feedback input of a inverting operational 426, reducing the second output of an inverting operational amplifier to a reduced feedback current 427, and supplying the reduced feedback current to a second feedback input of a inverting operational amplifier 428.

A first output current is received at an emitting photodevice at operation 422. The first output current may be emitting photodevice current 235. The emitting photodevice may be emitting photodevice 131 or emitting photodevice 231. Importantly, Operation 422 may be the same operation as operation 413. The emitting photodevice is a component of an optoelectric coupler. The optoelectric coupler may be optoelectric coupler 130 or optoelectric coupler 230. A second optical communication is emitted at an emitting photodevice at operation 423. The emitting photodevice may be emitting photodevice 131 or emitting photodevice 231. A second receiving photodevice receives a second optical communication from an emitting photodevice at operation 424. The second receiving photodevice may be second receiving photodevice 133 or second receiving photodevice 233.

The receiving photodevice generates a second receiving current at operation 425. The second receiving current generated may be second receiving current 237. The second receiving current is supplied to an inverting operational amplifier through a second non-feedback input at operation 426. The second non-feedback input may be second non-feedback input 151 or second non-feedback input 251.

The output current of the inverting operational amplifier is reduced and supplied back to a second feedback input of the inverting operational amplifier in operations 427 and 428. In some embodiments, the reduction of the second output current is accomplished by electrically communicating the second output of the inverting operational amplifier with a first resistor. The second output of the inverting operational amplifier may be second output 152 or second output 252. The first resistor may be first resistor 171 or first resistor 271. In other embodiments, the reduction of the second output current may be accomplished by an electrically communicating the second output of the inverting operational amplifier with a voltage divider. The voltage divider may be voltage divider 170 or voltage divider 270. The voltage divider decreases the voltage by a ratio based upon two or more resistors in electrical communication with a ground. The resistors may be a first resistor first resistor 171 or first resistor 271 and second resistor 172 or second resistor 272. The ground may be ground 173 or ground 273. The reduced current is then supplied back to inverting operational amplifier through a second feedback input which may be second feedback input 153 or second feedback input 253.

In other words, to control the second output current of the inverting operational amplifier, a first output current of a noninverting operational amplifier is received at an emitting photodevice. The emitting photodevice then emits a second optical communication to a second receiving photodevice. The second receiving photodevice then generates a second receiving current. The second receiving supplied to the non-feedback input of the inverting operational amplifier. The inverting operational amplifier generates a second output which is then reduced and supplied back to the feedback input of the inverting operational amplifier. Such a reduction in current may be accomplished via a first resistor or a voltage divider.

At operation 330, a current factor is determined that matches the first and second receiving currents in the optoelectric coupler. As discussed previously, the first and second receiving currents are generated by the optoelectric coupler's first and second receiving photodevices. The matching of the two currents is accomplished by the design of the optoelectric coupler's emitting and receiving photodevices.

At operation 440, matching of the first output current of the noninverting operational amplifier with the first and second receiving currents of the first and second receiving photodevices occurs. This matching may create the same current value in all three currents. This matching accomplishes electrical isolation, yet interdependence, of the inverting and noninverting operational amplifier as the first output current of the noninverting operational amplifier is matched with the non-feedback input current of the inverting operational amplifier. As the inverting operational amplifier's design creates a virtual ground with the non-feedback input to the inverting operational amplifier, a current is generated by the inverting operational amplifier that matches that of the noninverting operational amplifier. This accomplishes the electrical isolation of the two circuits while holding their currents to similar, if not the same voltage (e.g. a voltage following operation). In other embodiments, the second output of the inverting operational amplifier is reduced to, or is proportional to, the output of the noninverting operational amplifier for the reasons stated above, in conjunction with a reduction in the feedback current supplied to the inverting operational amplifier at the second feedback input.

At operation 450, the second output current is supplied to a lighting device. The lighting device may be lighting device 190 or lighting device 290. As discussed previously, the lighting device may be a solid state lighting device, and specifically, an LED.

Figure 5:
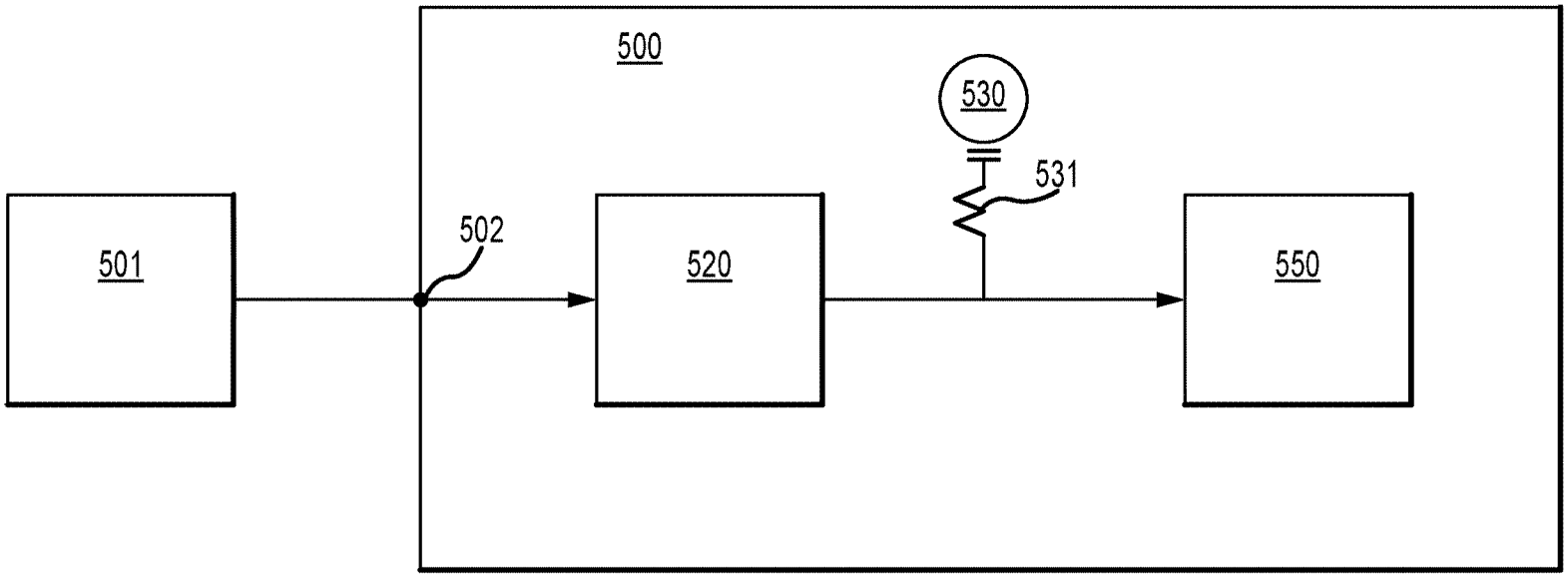
FIG. 5 illustrates a schematic of utilizing an isolated dimming circuit within a lighting device in accordance with embodiments described herein.

With reference to FIG. 5, a lighting device incorporating an isolated dimming circuit is illustrated. Lighting device 500 may comprise voltage input device 501, lighting device voltage input 502, isolated dimming circuit 520, light power source 530, resistor 531, and lighting element 550.

Voltage input device 501 may supply AC or DC current; this can be through various means such as a wall outlet, battery pack, or a solar cell. Voltage input device 501 may be the same as voltage input device 101 or 201. Voltage input device 501 is in electrical communication with lighting device voltage input 502, which is the primary voltage input of lighting device 500. Lighting device voltage input 502 may be the same as lighting device voltage input 291.

Lighting device 500 includes isolated dimming circuit 520. Isolated dimming circuit 520 may be the same as isolated dimming circuit 100, 200, or 320. Isolated dimming circuit 520 is in electrical communication with light power source 530 and resistor 531. Light power source 530 may be the same as light power source 293. Light power source 530 may be supplied by a variety of power sources including solar, battery, power stealing, or a combination of known power sources. Resistor 531 may be the same as resistor 292.

Lighting device 500 also includes lighting element 550. Lighting element 550 is in electrical communication with isolated dimming circuit 520, resistor 531, and light power source 530. Similar to lighting device 190, lighting element 550 may be a variety of lighting elements such as solid-state lighting (SSL), and specifically, LED type elements. Such lighting element may require dimming capabilities. In some embodiments, such lighting element may have an operational range of 0-480 volts. In other embodiments, such lighting element may have an operational range of 0-277 volts. In further embodiments, such lighting element may have an operational range of 0-10 volts.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. An isolated dimming circuit, the isolated dimming circuit comprising:

a voltage input device;

a noninverting operational amplifier comprising:

a first non-feedback input, wherein the first non-feedback input is in electrical communication with the voltage input device, a first feedback input, a first power source input, wherein the first power source input is in electrical communication with a first power source, and a first output;

an inverting operational amplifier comprising:

a second non-feedback input, a second feedback input, a second power source input, wherein the second power source input is in electrical communication with a second power source, and an second output;

an optoelectric coupler, wherein the optoelectric coupler comprises:

an emitting photodevice, wherein the emitting photodevice is in electrical communication with the first output of the noninverting operational amplifier, a first receiving photodevice, wherein the first receiving photodevice is in optical communication with the emitting photodevice, in electrical communication with the first feedback input of the noninverting operational amplifier, and is positioned in a first circuit wherein the first circuit is operationally configured for a first current, a second receiving photodevice, wherein the second receiving photodevice is in optical communication with the emitting photodevice, is in electrical communication with the second non-feedback input of the inverting operational amplifier, and is positioned in a second circuit wherein the second circuit is operationally configured for a second current, and wherein the first current and second current are operationally configured to be matched by a current factor;

a voltage output device, wherein the voltage output device is in electrical communication with the second output of the inverting operational amplifier; and a lighting device, wherein the lighting device is in electrical communication with the voltage output device.

2. The isolated dimming circuit of claim 1, wherein the first power source is in electrical communication with the first power source input of the noninverting operational amplifier and is selected from a group consisting of solar, battery, and power stealing.

3. The isolated dimming circuit of claim 1 further comprising:

a voltage divider, wherein the voltage divider is in electrical communication with the second output of the inverting operational amplifier and the second feedback input of the inverting operational amplifier, and wherein the voltage divider comprises:

a first resistor, a second resistor, and a ground, wherein the first resistor and the second resistor are positioned in series, the first resistor positioned between the second output of the inverting operational amplifier and the second feedback input of the inverting operational amplifier, and the second resistor positioned between the second feedback input of the inverting operational amplifier and the ground.

4. The isolated dimming circuit of claim 1 further comprises a resistor in electrical communication with, and positioned between, the second output of the inverting operational amplifier and the second feedback input of the inverting operational amplifier.

5. The isolated dimming circuit of claim 1, wherein the second power source is in electrical communication with the second power source input of the inverting operational amplifier and is selected from a group consisting of solar, battery, and power stealing.

6. The isolated dimming circuit of claim 1, wherein the emitting photodevice is a light emitting diode (LED).

7. The isolated dimming circuit of claim 1, wherein the first and second receiving photodevices comprise photodiodes.

8. The isolated dimming circuit of claim 1, wherein the first and second receiving photodevices comprise photoresistors.

9. The isolated dimming circuit of claim 1, wherein the first and second receiving photodevices comprise phototransistors.

10. The isolated dimming circuit of claim 1, wherein the voltage output device is operationally configured for a range of 0-10 Volts.

11. The isolated dimming circuit of claim 1, wherein the lighting device comprises a solid-state light.

12. The isolated dimming circuit of claim 1, wherein the voltage input device is an output of a non-isolated controller.

13. An isolated dimming circuit, the isolated dimming circuit comprising:

a voltage input device;

a noninverting operational amplifier, wherein the noninverting operational amplifier is in electrical communication with the voltage input device;

an inverting operational amplifier;

a current isolating device, wherein the noninverting operational amplifier is in electrical communication with a first circuit, the inverting operational amplifier is in electrical communication with a second circuit, the first circuit and the second circuit are operationally configured for a first current and second current, and the first current and second current are matched by a current factor;

a voltage output device wherein the voltage output device is in electrical communication with the inverting operational amplifier;

a lighting device, wherein the lighting device is in electrical communication with the voltage output device.

14. The isolated dimming circuit of claim 13 further comprising: a voltage divider, wherein the voltage divider is in electrical communication with the inverting operational amplifier.

15. The isolated dimming circuit of claim 13, wherein the voltage output device is operationally configured for a range of 0-10 Volts.

16. The isolated dimming device of claim 13, wherein the lighting device comprises a solid-state light.

17. A method for isolating a dimming circuit comprising:

supplying a voltage input at a voltage input device;

receiving the voltage input at a first non-feedback input of a noninverting operational amplifier;

generating a first output current at the noninverting operational amplifier;

controlling the first output current of the noninverting operational amplifier by:

receiving the first output current of the noninverting operational amplifier at an emitting photodevice, emitting a first optical communication at the emitting photodevice, receiving the first optical communication at a first receiving photodevice, generating a first receiving current at the first receiving photodevice, and supplying the first receiving current to the first feedback input of the noninverting operational amplifier;

generating a second output current at an inverting operational amplifier;

controlling the second output current of the inverting operational amplifier by:

receiving the first output current from the noninverting operational amplifier at the emitting photodevice, emitting a second optical communication at the emitting photodevice, receiving the second optical communication at the second receiving photodevice, generating a second receiving current at the second receiving photodevice, supplying the second receiving current to a second non-feedback input of the inverting operational amplifier, reducing the second output current to a reduced feedback current, and supplying the reduced feedback current to a second feedback input of the inverting operational amplifier;

determining a current factor that matches the first and second receiving currents of the first and second receiving photodevices;

matching the first output current of the noninverting operational amplifier with the first receiving current of the first emitting photodevice and the second receiving current of the second photodevice with an optoelectric coupler, wherein the optoelectric coupler comprises the emitting photodevice, the first receiving photodevice, and the second receiving photodevice, and matches the first and second receiving currents by the current factor; and supplying the second output current of the inverting operational amplifier to a lighting device.

18. The method of isolating a dimming circuit of claim 17, wherein the first and second optical communications are the same optical communication.

19. The method of isolating a dimming circuit of claim 17, wherein reducing the second output current comprises:

supplying the second output voltage to a voltage divider, dividing the second output voltage with the voltage divider, and generating the reduced feedback current.

20. The method of isolating a dimming circuit of claim 17, wherein the second voltage output of the inverting operational amplifier is in a range 0-10 Volts.

21. The method of isolating a dimming circuit of claim 17, wherein the lighting device comprises a solid-state light.

22. The method of isolating a dimming circuit of claim 17, wherein the voltage input is supplied by a non-isolated controller.

* * * * *